US007958697B2

(12) United States Patent
Rapparini

(10) Patent No.: US 7,958,697 B2
(45) Date of Patent: Jun. 14, 2011

(54) PROCESS FOR ASEPTIC PACKAGING OF STERILE LIQUIDS IN FLEXIBLE CONTAINERS

(76) Inventor: Gino Rapparini, Bologna (IT)

( * ) Notice: Subject to any disclaimer, the term of this patent is extended or adjusted under 35 U.S.C. 154(b) by 616 days.

(21) Appl. No.: 11/573,416

(22) PCT Filed: Jul. 18, 2005

(86) PCT No.: PCT/IB2005/002058

§ 371 (c)(1),
(2), (4) Date: Feb. 8, 2007

(87) PCT Pub. No.: WO2006/021839

PCT Pub. Date: Mar. 2, 2006

(65) Prior Publication Data

US 2009/0223173 A1 Sep. 10, 2009

(30) Foreign Application Priority Data

Aug. 26, 2004 (IT) ..... B02004A0534

(51) Int. Cl.
*B65B 55/02* (2006.01)

(52) U.S. Cl. ..... 53/425; 53/451; 53/551; 53/511

(58) Field of Classification Search ..... 53/425, 53/431, 456, 451, 511, 563, 551
See application file for complete search history.

(56) References Cited

U.S. PATENT DOCUMENTS

| | | | | | |
|---|---|---|---|---|---|
| 2,160,367 | A * | 5/1939 | Maxfield | 53/433 |
| 3,466,841 | A * | 9/1969 | Rausing | 53/426 |
| 3,815,318 | A | 6/1974 | Lerner | |
| 3,918,235 | A * | 11/1975 | Brown et al. | 53/451 |
| 4,144,693 | A * | 3/1979 | Ogata | 53/433 |
| 4,241,563 | A * | 12/1980 | Muller et al. | 53/511 |
| 4,317,321 | A * | 3/1982 | Torterotot et al. | 53/426 |
| 4,537,007 | A | 8/1985 | Lattanzi | |
| 4,606,174 | A * | 8/1986 | Berg | 53/451 |
| 4,617,779 | A * | 10/1986 | Nygren et al. | 53/433 |
| 4,769,974 | A * | 9/1988 | Davis | 53/433 |
| 4,964,259 | A * | 10/1990 | Ylvisaker et al. | 53/433 |
| 5,067,310 | A * | 11/1991 | Yamanaka | 53/551 |
| 5,669,208 | A * | 9/1997 | Tabaroni et al. | 53/453 |
| 5,813,197 | A * | 9/1998 | Aguzzoli | 53/453 |
| 6,035,614 | A * | 3/2000 | Gustafsson et al. | 53/551 |
| 6,413,350 | B1 * | 7/2002 | Boschi | 156/272.2 |
| 6,619,018 | B1 * | 9/2003 | Sasaki | 53/511 |
| 6,735,928 | B2 * | 5/2004 | Kondo et al. | 53/508 |
| 6,779,318 | B2 * | 8/2004 | Wang | 53/410 |
| 7,007,441 | B2 * | 3/2006 | Benedetti et al. | 53/167 |
| 7,484,347 | B2 * | 2/2009 | Konno et al. | 53/551 |
| 2004/0159574 | A1 | 8/2004 | Lewis et al. | |

* cited by examiner

*Primary Examiner* — Paul R Durand
(74) *Attorney, Agent, or Firm* — McNeely, Hare & War LLP; Kevin J. McNeely

(57) ABSTRACT

A process for aseptic packaging of sterile liquids in flexible containers including a pre-chamber pressurized with a sterilized inert fluid that is injected through an auxiliary line and flows out to activate a sterile barrier such as to allow complete asepsis of the packaging process. A pressing device compresses the film to form a seal against the outer surface of the feed tube that introduces sterile liquid into the aseptic packaging chamber.

8 Claims, 9 Drawing Sheets

PROCESS FOR ASEPTIC PACKAGING OF STERILE LIQUIDS IN FLEXIBLE CONTAINERS

TECHNICAL FIELD

The present invention relates to processes for packaging in containers made from continuous strips of flexible heat-sealable material. More specifically, the present invention concerns a procedure for aseptic packaging of liquid products. International reference classification: B65b; B65d.

BACKGROUND ART

Various processes for packaging liquids in containers made from flexible heat-sealable material are known in the scientific, technical and patent literature.

Of particular pertinence is the Italian patent BO 97 A 000391 of the same inventor, which illustrates in detail a process for packaging with STAND-UP containers obtained from a flat strip of flexible heat-sealable material.

The problem to be solved is to improve the process so as to ensure complete asepsis by keeping the product to be packaged completely isolated from the outside environment.

The solution proposed by the present industrial invention overcomes, in a simple, reliable and cost-effective manner, all of the problems tied to ensuring the asepsis of processes for packaging sterile liquid products by keeping the latter completely isolated from the outside environment.

DESCRIPTION

The invention will now be described in detail referring to the figures in the appended drawings, intended as non-restrictive examples.

Figure 1:
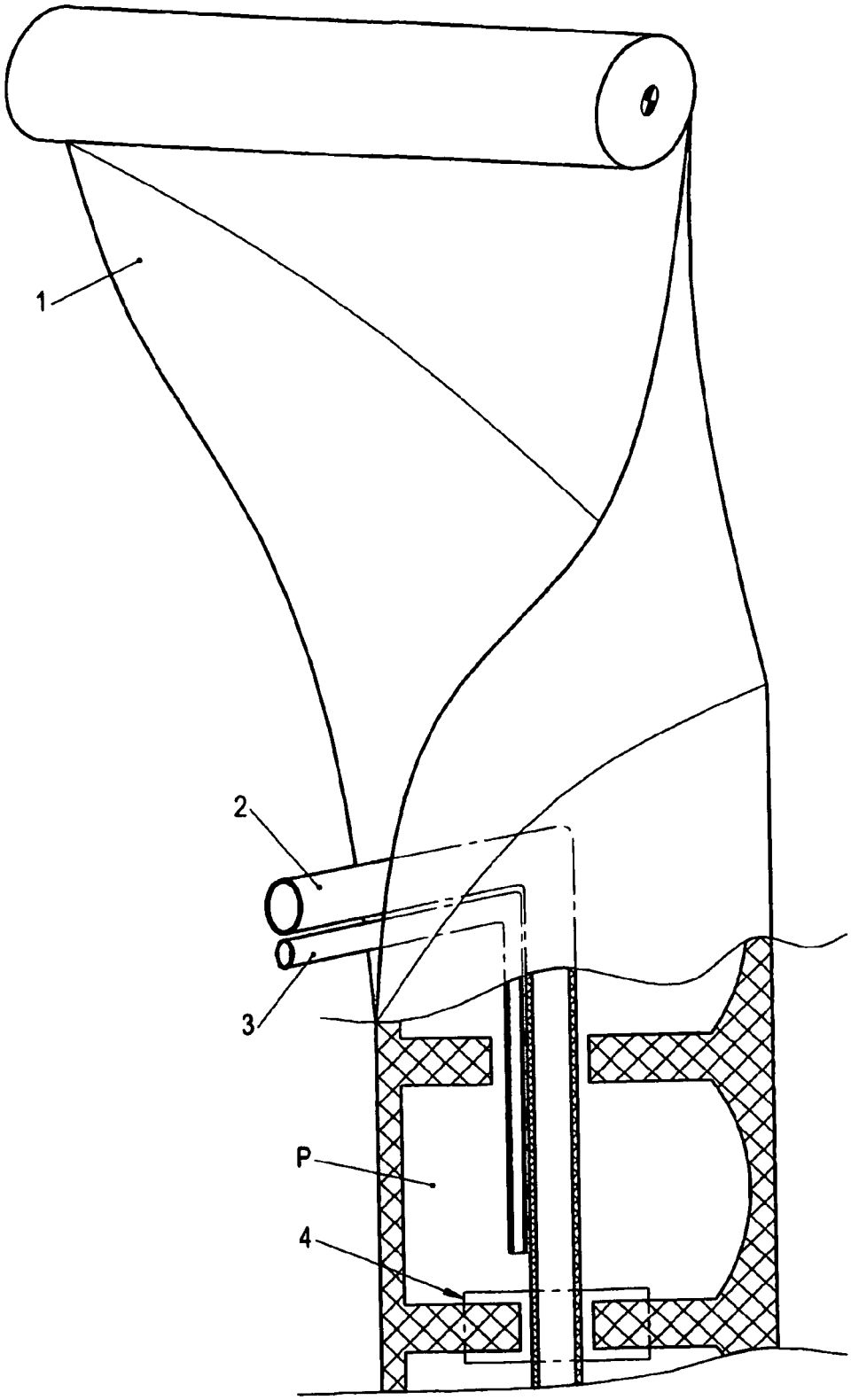

FIG. 1 is a partial perspective diagram showing the operating configuration at the start of the packaging process.

It may be noted that the strip of flexible material 1, folded and flattened, displays the same characteristics as illustrated in the aforementioned Italian patent BO 97 A 000371, or more precisely, a succession of combined seams arranged so as to be transformed into a sequence of compartments that will form the final packages. In FIG. 1 it is also possible to note, in proximity to the tube 2 for feeding sterile liquid, the presence of an auxiliary line 3, through which a pressurised sterilised fluid will be injected into pre-chamber P.

Figure 2:
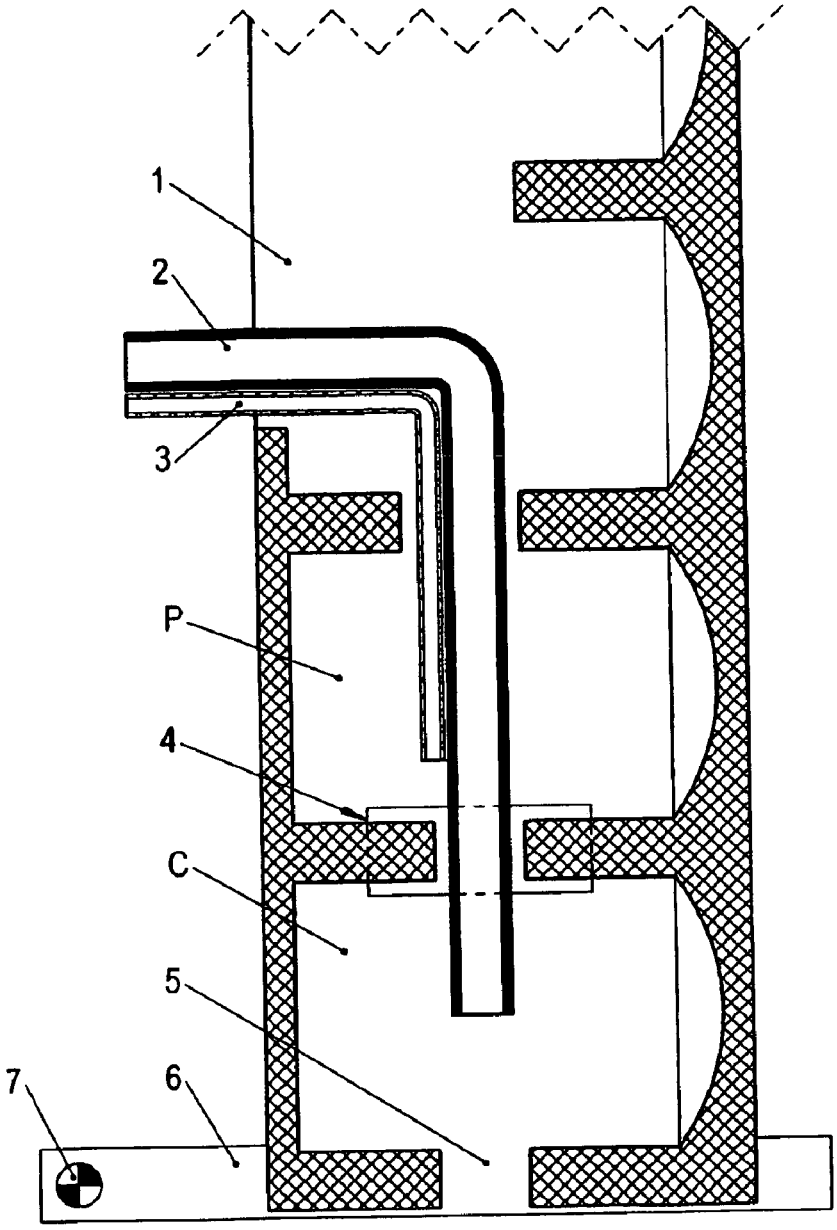

FIG. 2 schematically represents a median vertical cross-section of the aseptic packaging system. One may note the presence, in the section after pre-chamber P, of chamber C, fitted upstream with an external pressing device 4 and downstream with a transverse sealing device 6 in a position corresponding to the central opening 5.

Figure 3:
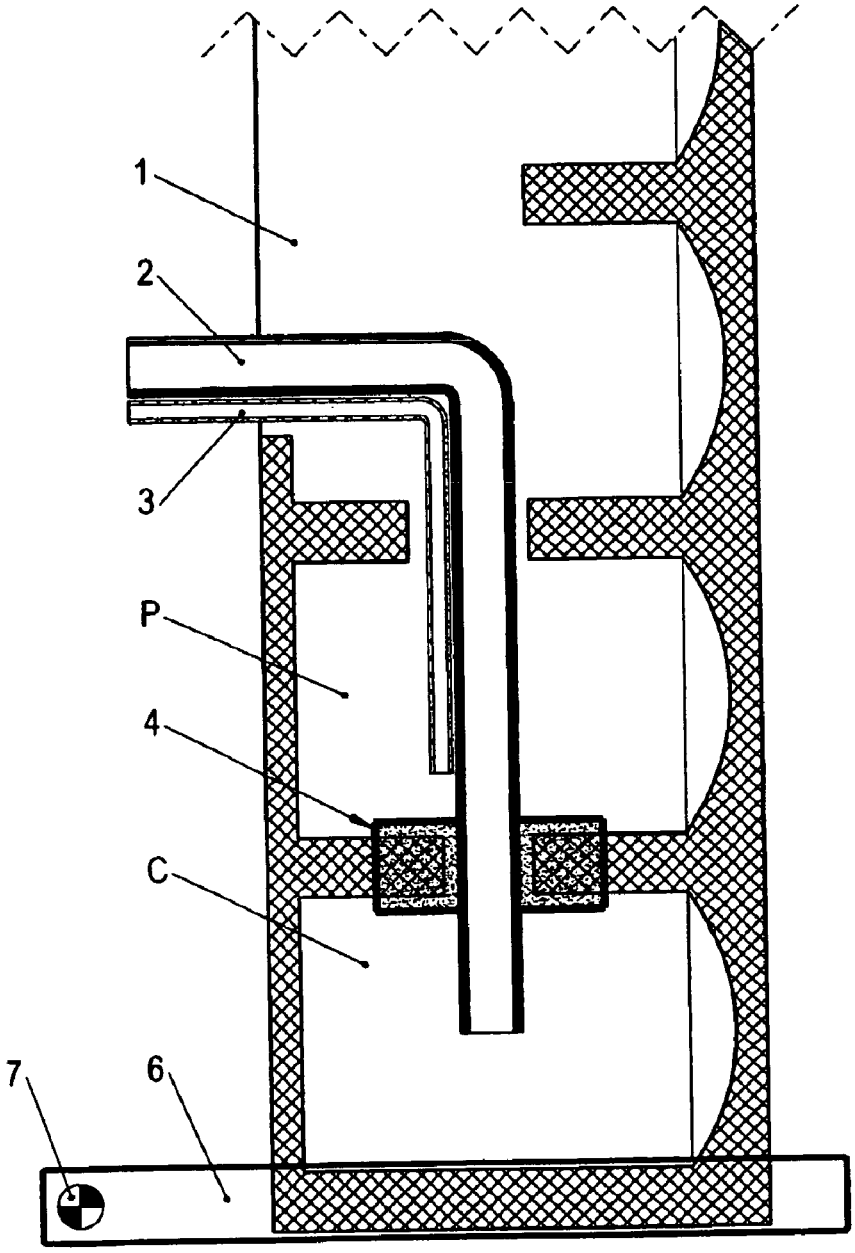

FIG. 3 illustrates the external action of the pressing device 4 and transverse sealing device 6 during the preparatory phase of the packaging process. It may be noted that chamber C is already isolated from the outside environment.

Figure 4:
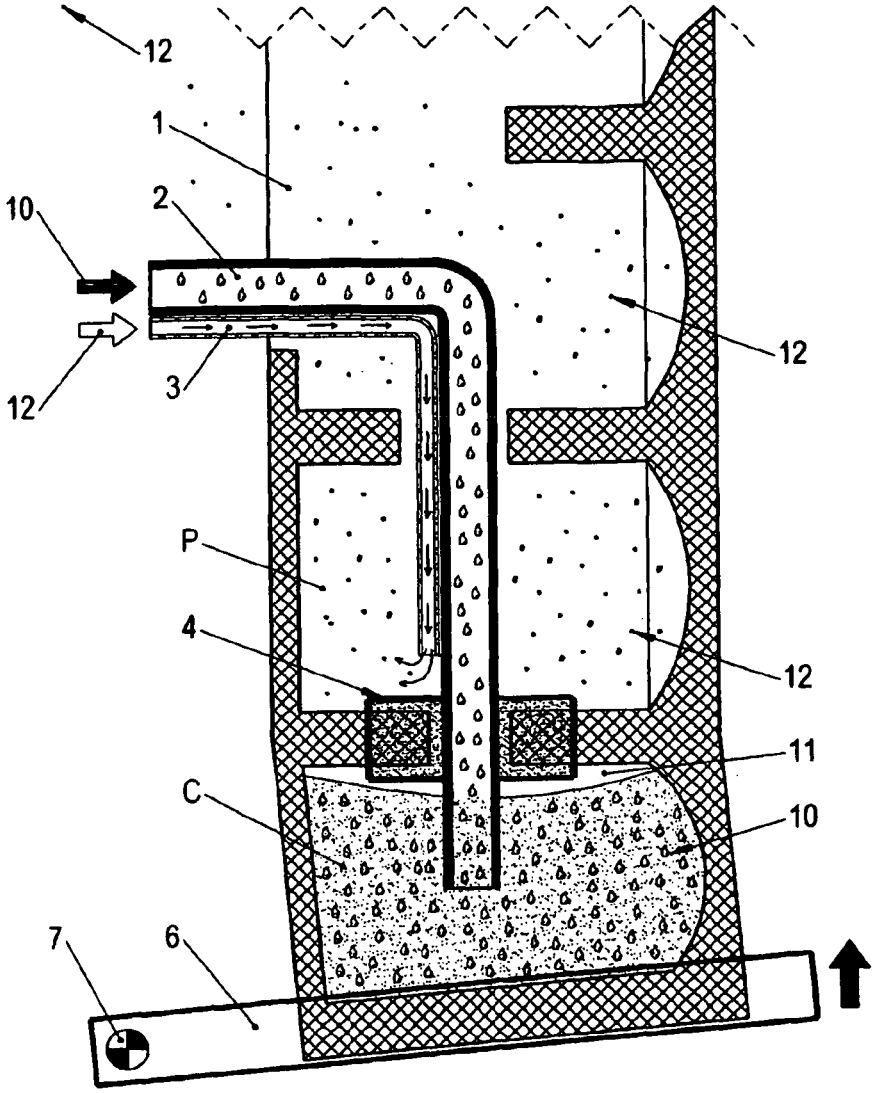

FIG. 4 illustrates the phase during which the sterile liquid 10 is fed in through tube 2 and the simultaneous pressurised injection of sterile inert fluid 12 through the auxiliary line 3.

Particular emphasis should be laid on the following circumstances;

- the transverse sealing device 6 is provided with a hinge 7 enabling its free end to be raised while chamber C is being filled with liquid 10.
- the lower part of chamber C is sealed while the upper part is isolated from the outside environment thanks to the presence of pressurised fluid 12 in pre-chamber P.

It should be noted that the heat-sealing device 6 is always operative, even while its free end is raised due to the swelling of the package being filled with liquid 10.

This characteristic serves to optimise the production cycle.

Figure 5:
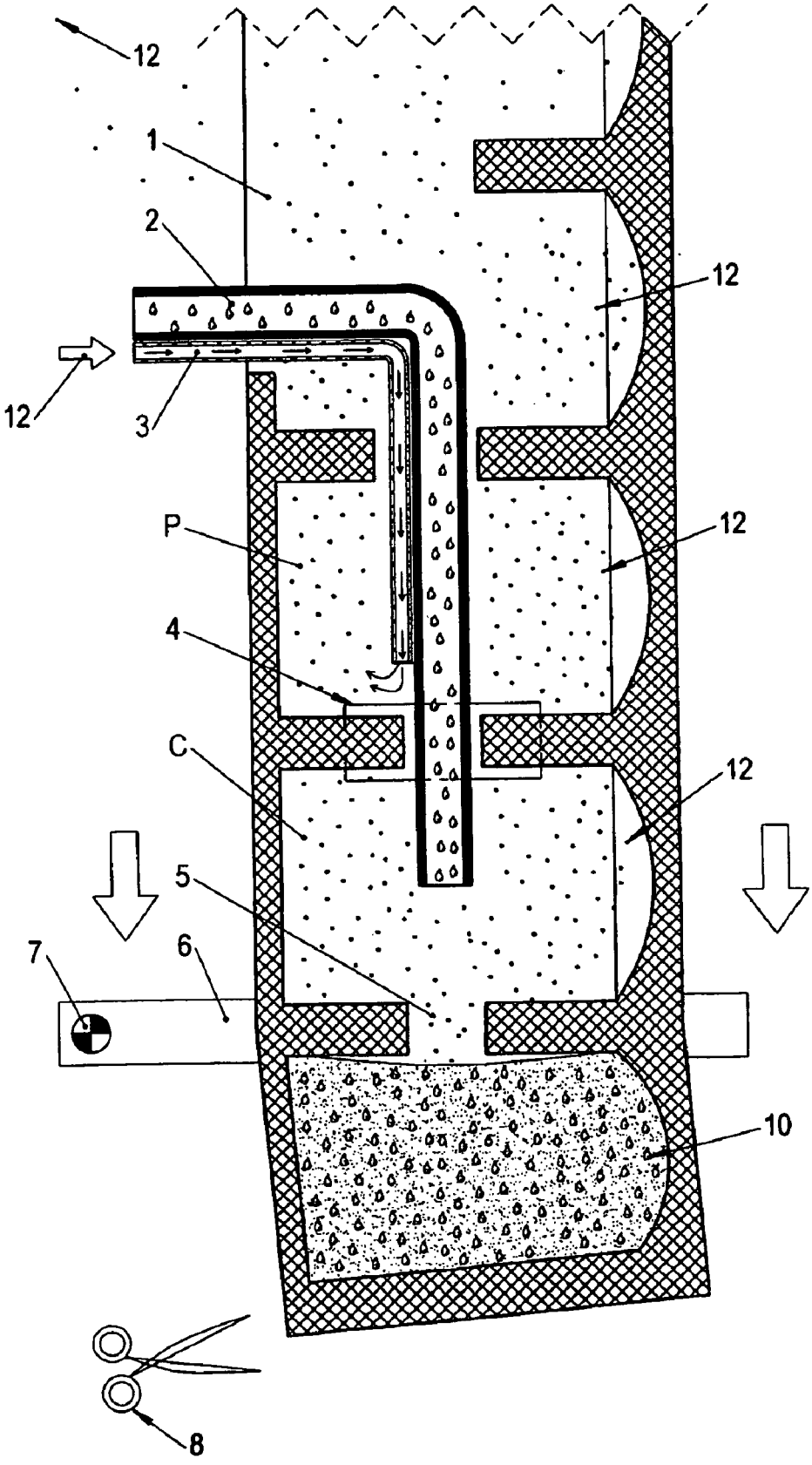

FIG. 5 illustrates the subsequent transit of an already filled package. It may be noted that both the pressing device 4 and clamps 6 have opened precisely in order to permit the filled package to descend.

It may be noted that the outflow of liquid 10 from the feed tube 2 is prevented by the pressure of fluid 12 inside chamber C, while said fluid 12 continues to flow from the auxiliary line 3 and rise toward the outside atmosphere, forming a barrier that guarantees the complete asepsis of the filling process. It is also possible to note the presence of the open cutting device 8.

Figure 6:
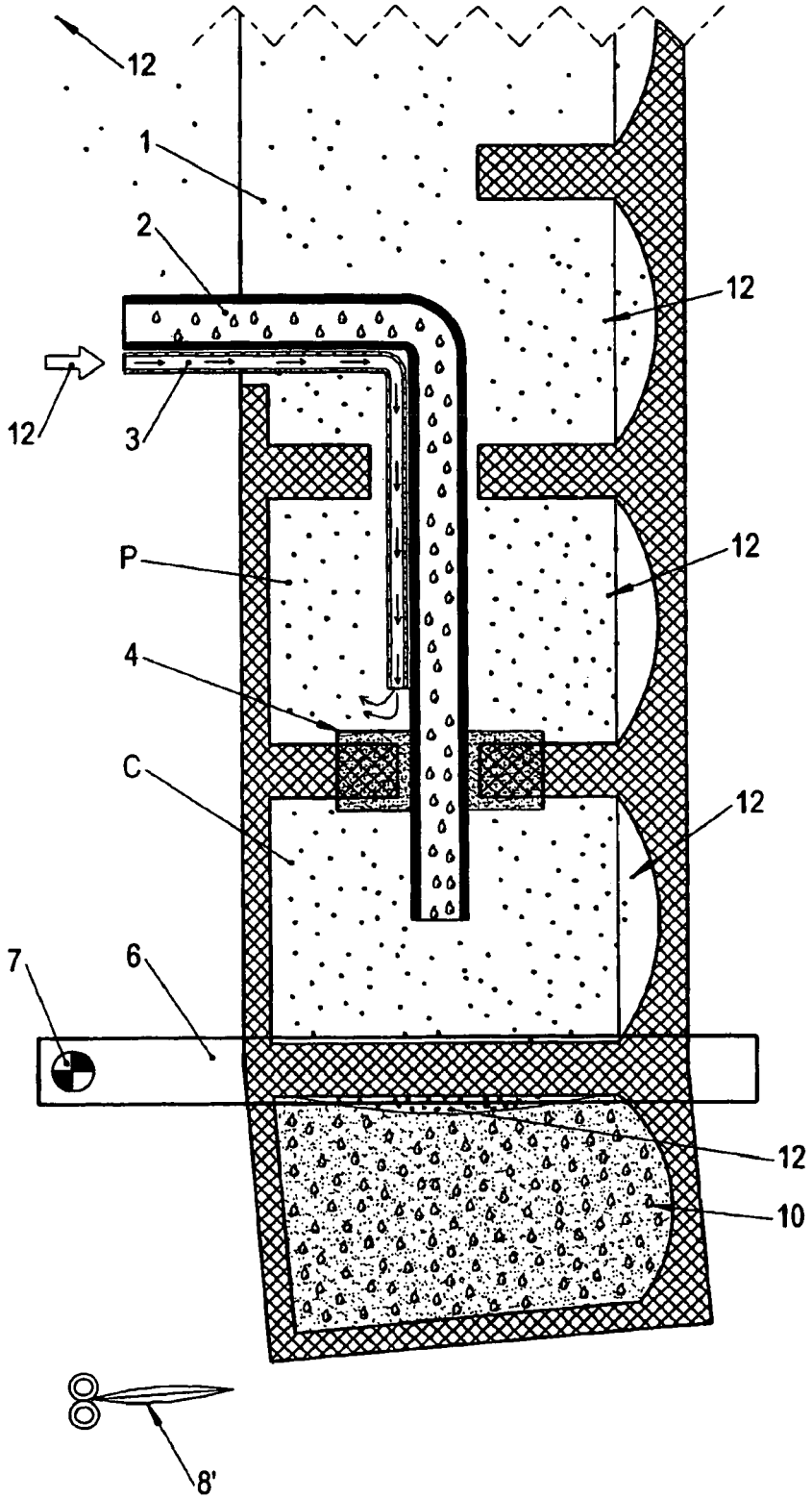

FIG. 6 illustrates the action of the transverse clamps 6 and external pressing device 4. It may be noted that device 8' has closed in order to cut the lower extremity.

Figure 7:
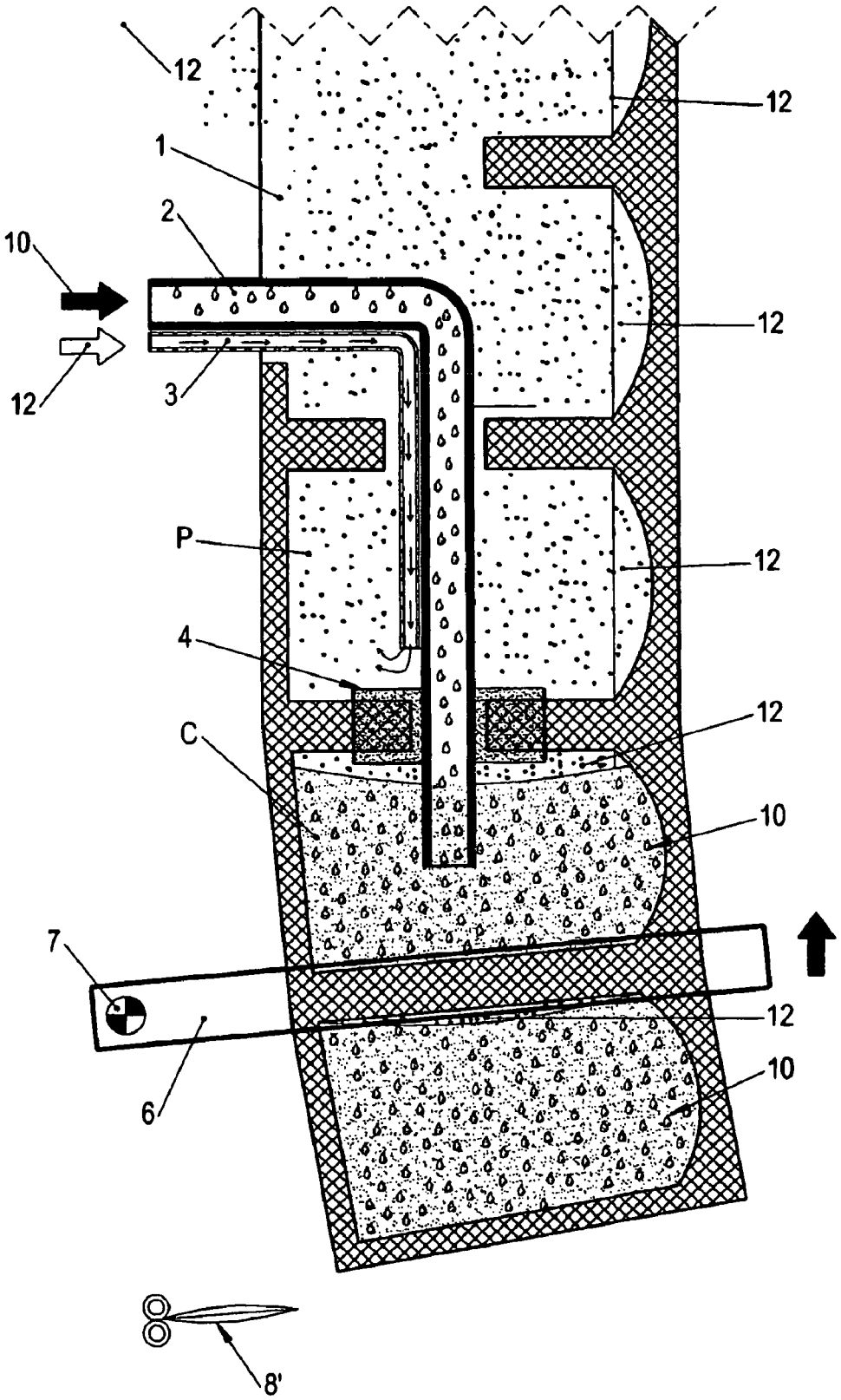

FIG. 7 illustrates the filling of the subsequent package and the consequent raising of the sealing clamps 6 with hinges 7. It may be noted that liquid 10 is fed from tube 2 while the inert sterile fluid 12 continues to flow out of the auxiliary line 3 and rise toward the outside to guarantee the aseptic nature of the packaging process.

Figure 8:
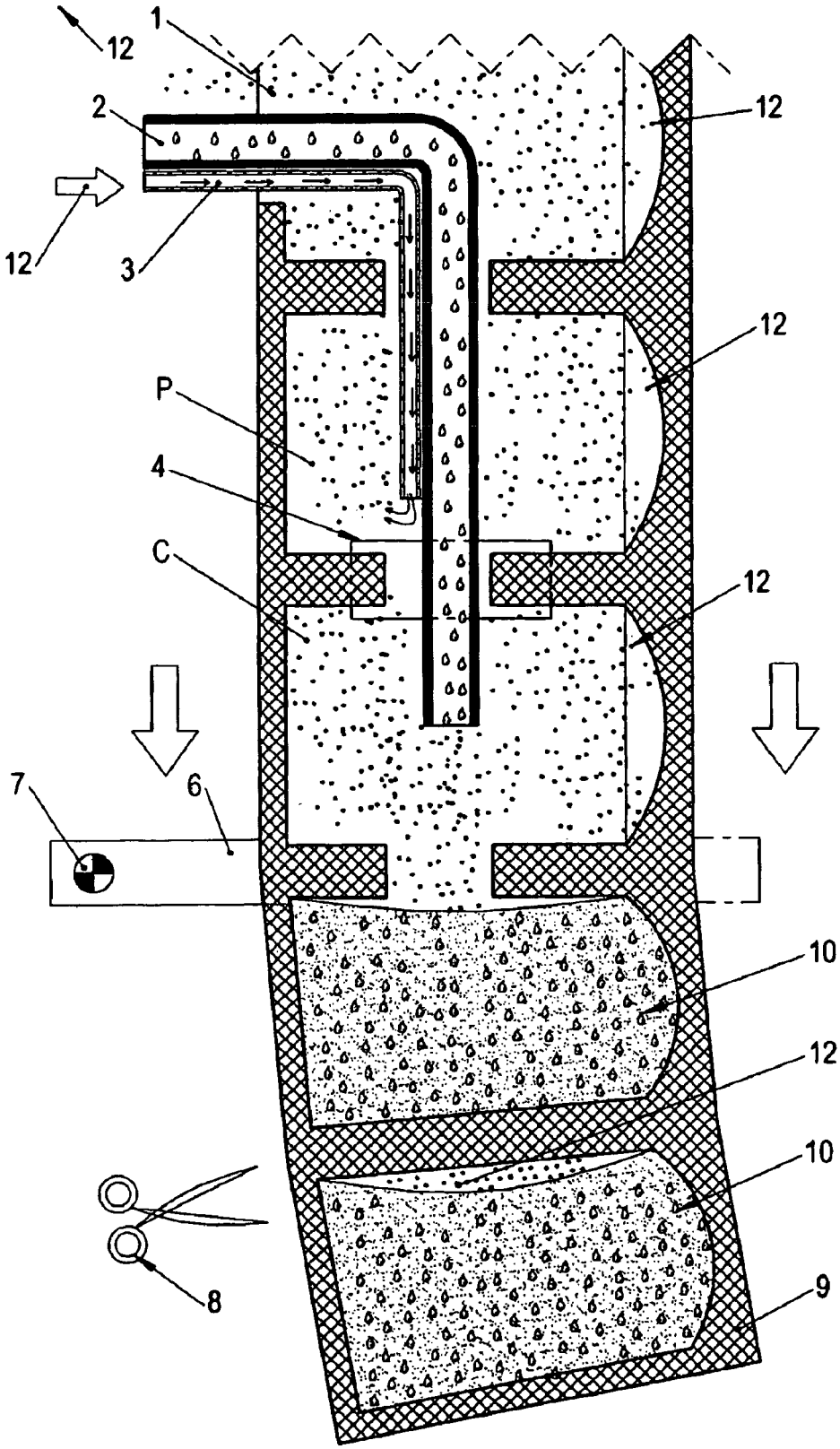

FIG. 8 illustrates the subsequent step in the packaging process. It may be noted that liquid is not discharged from the feed tube 2, while the outflow of sterile inert fluid 12 from the auxiliary line 3 continues to ensure the aseptic nature of the filling process.

Figure 9:
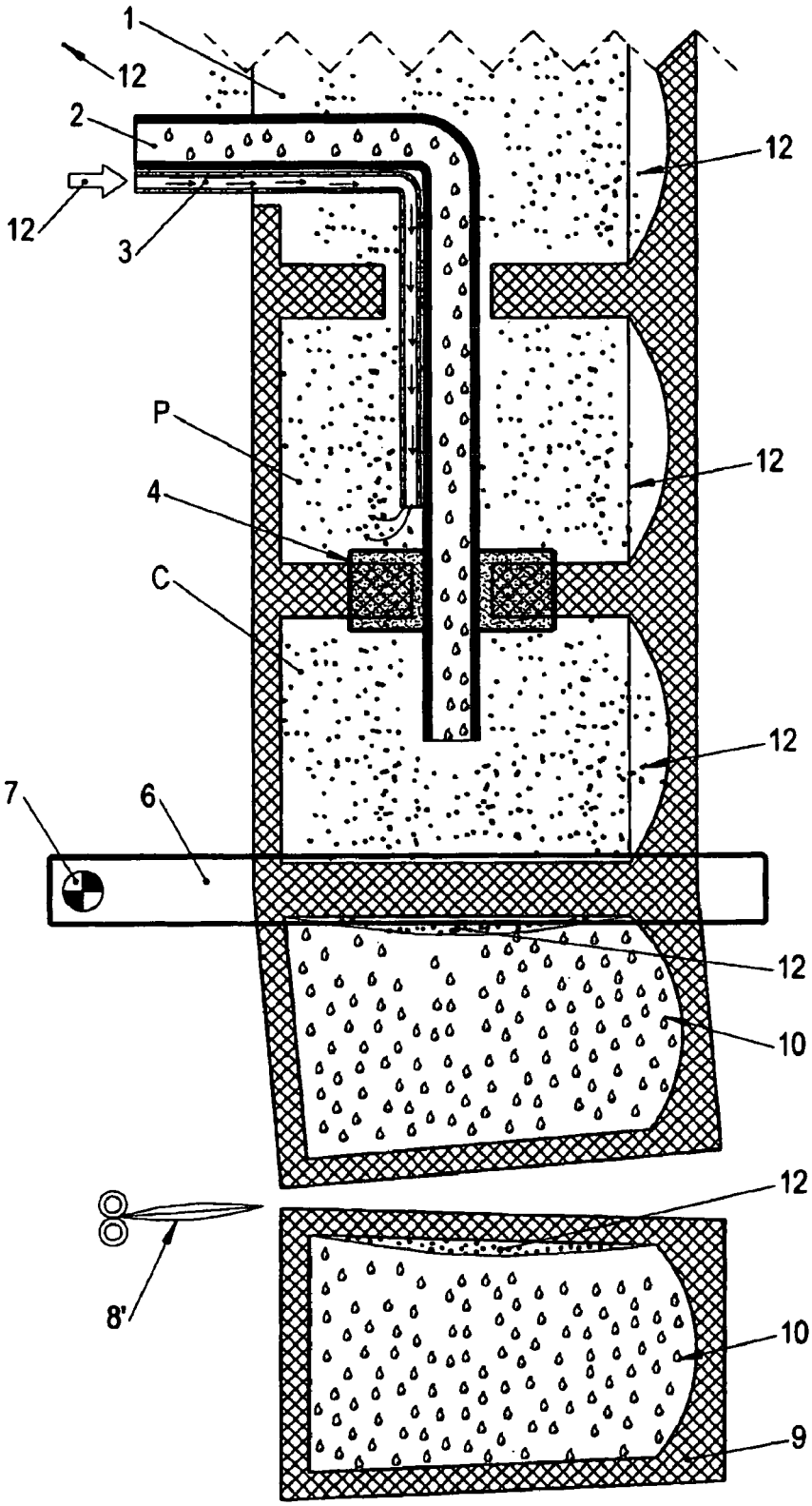

FIG. 9 illustrates the cutting of the resulting sealed package. It is possible to note the cutting action of device 8', which has closed in synchrony with the sealing action of the transverse clamps 6 and external pressing device S. It is likewise evident that a small part of sterile inert fluid 12 may be present inside the package. In the figures each individual item is marked as follows:

1 indicates the flat strip of flexible heat-sealable material, folded and flattened, on which a series of combined seams is applied so as to obtain a sequence of compartments that will form the finished packages, as illustrated and described in the aforementioned Italian patent BO 97 A 000371.
2 indicates the sterile liquid feed tube.
3 indicates an auxiliary line for introducing a sterilised inert fluid.
4 indicates an external pressing device that forms a seal between the flexible film 1 and the outer wall of the feed tube 2.
5 indicates the central opening permitting the passage of the feed tube 1.
6 indicates a device for heat-sealing the opening 5.
7 indicates the hinge enabling the clamp 6 to be raised as liquid is introduced into the package.
8 indicates a cutting device open in the standby phase.
8' indicates the same device closed in the cutting phase.
9 indicates a finished package.
10 indicates the liquid to be packaged.
11 indicates the vapour phase of liquid 10.
12 indicates a sterile inert fluid.
P indicates an aseptic pre-chamber.
C indicates the packaging chamber.

The figures bring to light the operational simplicity of the process for aseptic packaging of sterile liquids.

The invention naturally lends itself to different embodiments as regards both the dimensions and structural proportions of the various components used for its practical realisation, as well as the technological choices made according to market requirements and trends in respect of liquids packaged with flexible heat-sealable material. On being acquainted with the inventive combinations disclosed herein, any technician with average skill in this branch of the art will be able to devise, by means of simple technical deductions, without expending any inventive effort, a process for aseptic packaging of sterile liquids having the innovative characteristics as substantially described, illustrated and claimed below.

The invention claimed is:

1. A process for aseptic packaging a sterile liquid into packages, the packages being made of a strip of flexible material, folded and flattened, to form a sequence of chambers or compartments, which will finally form the packages, the process comprising:

pressuring a pre-chamber, which is arranged upstream with respect to a chamber to be filled with the sterile liquid, with a sterilized inert fluid by injecting the sterilized inert fluid through an auxiliary line, which reaches only into the pre-chamber, for activating a sterile barrier allowing complete asepsis of the packaging process;

compressing the flexible material between the pre-chamber and the chamber by a pressing device to form a seal against an outer surface of a tube for feeding the sterile liquid into the chamber;

introducing the sterile liquid into the chamber via the tube; and transverse sealing a lower part of the chamber by a transverse sealing device.

2. The process of claim 1, wherein the lower part of the chamber is heat sealed.

3. The process of claim 1, wherein the transverse sealing device is risen at one end thereof in synchrony with the introduction of the sterile liquid, even during the heat sealing operation.

4. The process of claim 3, wherein the one end of the transverse sealing device is risen oblique relative to the vertical direction.

5. The process of claim 1, further comprising:

cutting the sealed lower part of the chamber by a cutting device.

6. The process of claim 5, wherein the cutting, transverse sealing, and compressing are performed in synchrony.

7. The process of claim 1, wherein the sequence of chambers is provided in a vertical direction.

8. The process of claim 1, wherein the sequence of chambers is formed and the compressing is performed such that the chamber is isolated from an outside environment.

* * * * *